United States Patent [19]

LaFleur

[11] Patent Number: 4,552,361

[45] Date of Patent: Nov. 12, 1985

[54] JIG-SAW PUZZLE WORK BOARD

[76] Inventor: Robert H. LaFleur, 1729 Cresthill, Royal Oak, Mich. 48073

[21] Appl. No.: 581,735

[22] Filed: Feb. 21, 1984

Related U.S. Application Data

[60] Continuation-in-part of Ser. No. 419,966, Sep. 20, 1982, Pat. No. 4,479,651, which is a division of Ser. No. 236,803, Feb. 23, 1981, abandoned.

[51] Int. Cl.[4] ..... A63F 9/10; B65D 85/00

[52] U.S. Cl. ..... 273/157 R; 206/315.1; 273/DIG. 30

[58] Field of Search ..... 273/157 R, DIG. 30; 128/DIG. 15; 24/306, 442; 190/109, 110, 118, 119; 220/94 R; 206/315.1

[56] References Cited

U.S. PATENT DOCUMENTS

| | | | |
|---|---|---|---|
| 2,914,105 | 11/1959 | Kushysnski et al. | 150/110 |
| 3,504,915 | 4/1970 | Walker | 273/157 R |
| 3,729,752 | 5/1973 | Huggins | 128/DIG. 15 X |
| 3,792,668 | 2/1974 | Ward | 273/157 R X |
| 4,154,339 | 5/1979 | Dutra | 273/157 R X |
| 4,157,763 | 6/1979 | Betlejewski et al. | 220/94 R |
| 4,436,307 | 3/1984 | Caldwell | 273/157 R |

*Primary Examiner*—Anton O. Oechsle

*Attorney, Agent, or Firm*—Hauke & Patalidis

[57] ABSTRACT

A jig-saw puzzle work board having a frame with a recess formed in one lateral surface of the frame. The bottom of the recess forms a work surface for the assembly of the pieces of a jig-saw puzzle. A padding of resilient foam material is provided which has dimensions permitting the padding to be removably fitted into the recess with a snug fit. A surface of the padding engages the puzzle pieces and applies them against the work surface. A lid retains the padding in the recess of the frame. The lid is removably affixed across the recess-provided surface of the frame by a novel arrangement of Velcro material and complementary Velcro material.

3 Claims, 3 Drawing Figures

FIG. 1
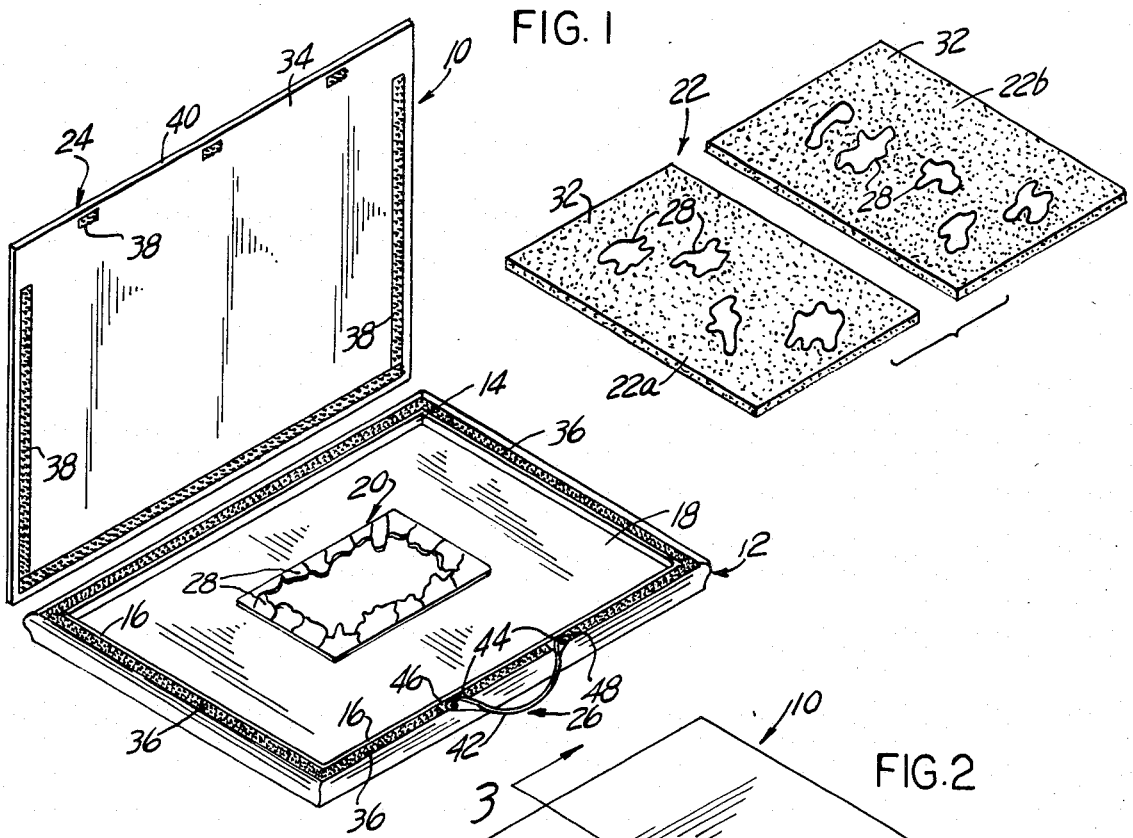
FIG. 2
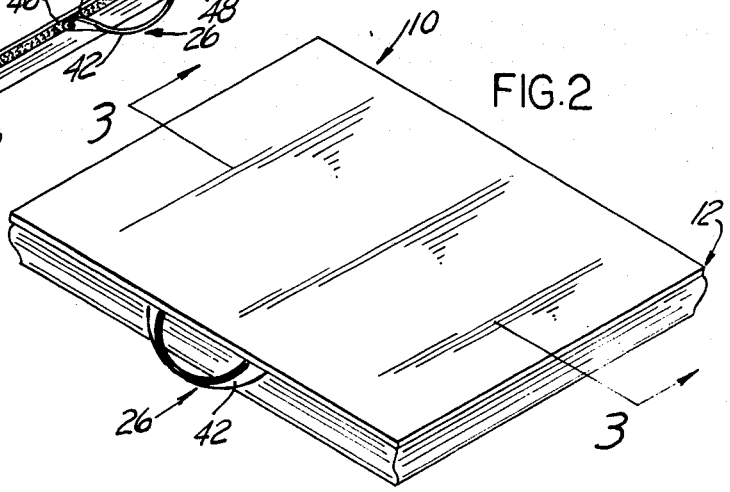
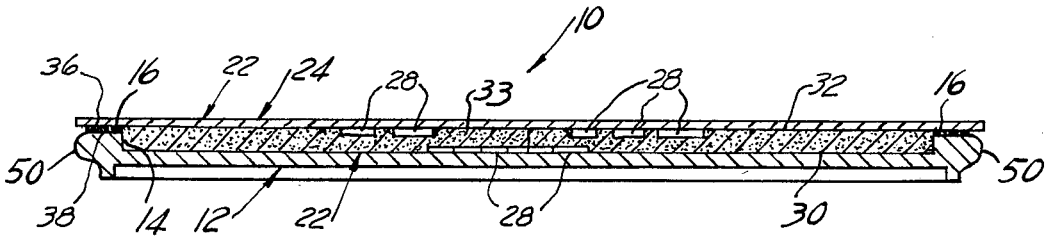
FIG. 3

JIG-SAW PUZZLE WORK BOARD

CROSS-REFERENCE TO RELATED APPLICATION

This application is a continuation-in-part of application Ser. No. 419,966, filed Sept. 20, 1982, now U.S. Pat. No. 4,479,651, which is a division of application Ser. No. 236,803, filed Feb. 23, 1981, now abandoned.

BACKGROUND OF THE INVENTION

The present invention relates to a jig-saw puzzle work board and storing device. More particularly, the invention relates to an improved design for a portable jig-saw puzzle work board of the type shown, for example, in applicant's co-pending application, Ser. No. 419,966.

Anyone who has ever indulged in piecing together jig-saw puzzles has experienced the frustration of searching for an adequate work surface, such as a spare table, on which to assemble the puzzle pieces. Another aggravation is discovering in the morning that a partially-done puzzle left overnight on a table has been upset by a pet or a child.

For these reasons, several attempts have been made in the prior art to provide a suitable work board for assembling jig-saw puzzles. However, none of the prior art devices is completely satisfactory due to failure to provide a lightweight structure which is simple and inexpensive to manufacture, which has convenient means for opening and closing the device without upsetting the pieces of a partially assembled puzzle being retained therein, and which provides a deformable and resilient padding, unattached to any other portion of the device, for placing thereon pieces of the puzzle prior to assembly.

SUMMARY OF THE INVENTION

These and other problems are solved by the present invention which provides a portable jig-saw puzzle work board of relatively simple construction, having a rectangular frame, a recess in one lateral surface of the frame with a substantially-flat work surface defined by the bottom of the recess, a deformable and resilient padding with dimensions permitting the padding to be removably fitted in the recess of the frame with a snug fit, a removable lid for retaining the padding in the recess and novel fastening means for removably affixing the lid across the recess-provided surface of the frame. When fitted in the recess, the padding holds the pieces of a partially assembled puzzle securely in position against the work surface at the bottom of the recess. When removed from the recess, the padding provides a convenient display surface for puzzle pieces which have not yet been assembled on the work surface.

The many objects and advantages of the present invention will become apparent to those skilled in the art when the following description of the best mode contemplated for practicing the invention is read in conjunction with the accompanying drawing wherein like reference numerals refer to like elements and in which:

BRIEF DESCRIPTION OF THE DRAWING

FIG. 1 is a perspective view of a jig-saw puzzle work board in an open position, according to the present invention;

FIG. 2 is a perspective view of the jig-saw puzzle work board of FIG. 1 in a closed position; and FIG. 3 is a sectional view along line 3—3 of FIG. 2.

DETAILED DESCRIPTION OF THE PREFERRED EMBODIMENTS

Referring now to FIG. 1 of the drawing, an example of a portable jig-saw puzzle work board 10 is shown having a four-sided, substantially rectangular frame 12. A substantially rectangular recess 14 is formed in one lateral surface of the frame 12 with a non-recessed rim 16 bordering the recess 14 on all four sides thereof. The bottom of the recess 14 defines a substantially flat work surface 18 for reconstructing a jig-saw puzzle, such as the partially assembled puzzle shown at 20. A substantially rectangular, deformable and resilient padding 22 is provided, preferably formed of two substantially identical sections 22*a*, 22*b*, for removable insertion into the recess 14. The work board 10 further comprises a substantially-rectangular cover or lid 24, fastening means for removably affixing the lid 24 over the recess-provided surface of the frame 12, and a handle member 26 for carrying the work board 10 from one location to another. Each of the elements of the work board 10 is set forth in detail hereafter.

At FIG. 1 the work board 10 is shown in an open position, with the cover 24 separated from the frame 12 and the padding 22 removed from the recess 14 in the frame 12. More particularly, the two sections 22*a*, 22*b* of the padding 22, which, as shown, are placed adjacent to the frame 12, provide a convenient non-slip surface for displaying unassembled jig-saw puzzle pieces 28. This arrangement permits a user to lift appropriate puzzle pieces 28 from the padding 22 for assembly into a puzzle 20 on the work surface 18 at the bottom of the recess 14.

In most instances, a user will only partially complete the puzzle 20 during one work session and will desire to store the partially-completed puzzle 20, together with the unassembled puzzle pieces 28, in the workboard 10 until a future time. To do so, the user closes the work board 10 by placing the two sections 22*a*, 22*b* of the padding 22 side-by-side in the recess 14 of the frame 12 and affixing the lid 24 over the recess-provided surface of the frame 12. The inserted padding 22 is configured to have a snug fit in the recess 14 of the frame 12 and to have a thickness substantially corresponding to the distance from the top of the rim 16 surrounding the recess 14 to the work surface 18 formed at the bottom of the recess 14. When inserted, the padding 22 resiliently engages the partially completed puzzle 20 on the work surface 18, FIG. 3, and holds the puzzle 20 in a fixed position by elastic deformation of a portion of the lower surface 30 of the padding 22 over the puzzle 20. It is readily apparent that, as shown at 33, a portion of the upper surface 32 of the padding 22 will be caused to protrude slightly above the rim 16 and Velcro material by the presence of the puzzle 20 held beneath the lower surface 30 of the padding 22. Affixing the lid 24 over the recess-provided surface of the frame 12 serves to retain the pading 22 in the recess of the frame 12 and to downwardly compress the padding 22 against the puzzle 20. In addition, the lid 24 presses any unassembled puzzle pieces 28 resting on the upper surface 32 of the padding 22 into the main body portion of the padding 22, thereby capturing the puzzle pieces between the lid 24 and padding 22, as also shown at FIG. 3.

The padding 22 is not attached to any other portion of the work board 10. This permits a user to place the padding 22 in the recess 14 over a puzzle 20 on the work surface 18, thereby holding the puzzle 20 in a fixed position against the work surface 18, and then to assemble a second puzzle on the upper surface 32 of the padding 22, which second puzzle can be held in position by affixing the lid 24 over the frame 12.

Referring again to FIG. 1, the fastening means for removably affixing the lid 24 over the recess-provided surface of the frame 12 is in the form of Velcro material attached to the rim 16 of the frame 12, as by cementing, for example, and complementary Velcro material attached to a lateral surface 34 of the lid. As shown, the Velcro material is in the form of a plurality of strips 36 affixed to the rim 16, thereby being disposed proximate, and extending parallel to, the respective edges of the frame 12. The complementary Velco material is also in the form of a plurality of strips 38, which are disposed proximate, and extend parallel to, the respective edges of the lid 24. An important aspect of the invention is to provide substantially less complementary Velcro material along one of the edges of the lid 24, shown as 40 at FIG. 1, than along the other edges so that the lid 24 has less adhesion to the rim 16 of the frame 12 along edge 40. Lesser adhesion along edge 40 of the lid 24 permits the lid 24 to be detached from the frame, without undue jarring of the interior contents of the work board 10, by applying moderate lifting pressure to edge 40.

As shown at FIG. 1, the handle member 30 is in the form of a strap 42 attached to the rim 16 of the frame 12 proximate the middle of one edge of the frame 12. The respective ends of the strap 42 may be attached to the rim 16 of the frame 12 by any convenient set of fasteners 44, such as snap fasteners, rivets or nails. To prevent the projecting heads of the fasteners 44 and the ends of the strap 42 from interferring with the fit of the lid 24 and the rim 16 of the frame 12, it is preferable to provide two spaced-apart sections 46, 48 of the rim 16 on which no Velcro material is attached. Each section 46, 48 of the rim 16 not provided with Velcro material is at least wide enough to accept the head of a fastener 44 and an end of the strap 42.

As an example of a method for making a jig-saw puzzle work board according to the invention, a recess 14 of the type previously described is cut into one lateral surface of a substantially rectangular piece of wood, for example, such that a non-recessed rim 16 is formed on the same lateral surface of the piece of wood about the periphery of the recess 14. The edges of the rectangular piece of wood are provided with a curvilinear, decorative shape, as shown at 50 of FIG. 3. Strips 36 of Velcro material are cemented or glued around the peripheral rim 16 surrounding the recess 14. A rectangular padding 22 is formed such as to be freely disposable in the recess 14 of the frame 12 with a snug fit and to have a thickness enabling the padding 22 to extend from the top of the rim 16 to the bottom of the recess 14. A handle member 30 is also attached to the non-recessed, peripheral rim 16. A second substantially rectangular piece of wood is provided onto which complementary strips 38 of Velcro material are cemented or glued. More particularly, the strips 38 of complementary Velcro material are attached proximate, and extend parallel to, the respective edges of the second substantially-rectangular piece of wood. However, substantially less complementary Velcro material is attached along one edge 40 of the second piece of wood than is attached along th other edges.

Having thus described the present invention by way of examples of structure well adapted to accomplish the purpose of the invention, modification whereof will be apparent to those skilled in the art, what is claimed as new is as follows:

1. A portable jig-saw puzzle work board comprising a substantially rectangular frame forming a rim having an edge bordering a substantially rectangular recess, a resilient padding having dimensions permitting said padding to be removably fitted into said recess with a snug fit, a removable lid for retaining said padding in said recess and fastening means for removably affixing said lid across said rim of said frame, wherein a substantially flat work surface is formed across the bottom of said recess, said padding has a thickness substantially corresponding to the distance from said rim of said frame to said work surface formed at the bottom of said recess and, said fastening means comprising Velcro material attached to said rim of said frame and complementary Velcro material attached to a marginal surface of said lid, said Velcro material being in the form of a plurality of strips disposed proximate and extending parallel to the edge of said frame rim and said complementary Velcro material being in the form of a plurality of strips disposed proximate and extending parallel to each edge of said lid, wherein substantially less complementary Velcro material is provided along one edge of said lid than is provided along the other edges of said lid so that said lid has less adhesion to said rim of said frame along one edge than along said other edges.

2. The jig-saw puzzle work board of claim 1 wherein said padding is formed of two substantially identical sections.

3. The jig-saw puzzle work board of claim 1 further comprising a handle attached to said frame.

* * * * *